United States Patent [19]

Kardos et al.

[11] 3,956,078

[45] May 11, 1976

[54] ELECTRODEPOSITION OF COPPER

[75] Inventors: Otto Kardos, Ferndale; Donald A. Arcilesi, Mount Clemens; Silvester P. Valayil, Pontiac, all of Mich.

[73] Assignee: M & T Chemicals Inc., Greenwich, Conn.

[22] Filed: Nov. 21, 1974

[21] Appl. No.: 525,713

Related U.S. Application Data

[63] Continuation-in-part of Ser. No. 315,112, Dec. 14, 1972, abandoned.

[52] U.S. Cl. ..... 204/52 R

[51] Int. Cl.[2] ..... C25D 3/38

[58] Field of Search ..... 204/52 R, 44; 106/1

[56] References Cited

UNITED STATES PATENTS

| | | | |
|---|---|---|---|
| 2,849,351 | 8/1958 | Gundel et al. | 204/44 |
| 2,849,352 | 8/1958 | Kirstahler et al. | 204/44 |
| 3,000,800 | 9/1961 | Strauss et al. | 204/52 R |
| 3,023,150 | 2/1962 | Willmund et al. | 204/44 |
| 3,081,240 | 3/1963 | Strauss et al. | 204/52 R |
| 3,267,010 | 8/1966 | Creutz et al. | 204/52 R |
| 3,328,273 | 6/1967 | Creutz et al. | 204/52 R |
| 3,542,655 | 11/1970 | Kardos et al. | 204/52 R |
| 3,650,915 | 3/1972 | Quimby et al. | 204/52 R |
| 3,682,788 | 8/1972 | Kardos et al. | 204/52 R |
| 3,732,151 | 5/1973 | Abbott | 204/52 R |

*Primary Examiner*—G. L. Kaplan
*Attorney, Agent, or Firm*—Kenneth G. Wheeless; Robert P. Auber; Robert Spector

[57] ABSTRACT

This invention relates to novel compositions and to a process for electrodepositing copper from an aqueous acidic copper plating bath containing at least one member independently selected from each of the following two groups:

A. an aryl, aralkyl or cycloaliphatic amine exhibiting the formula:

wherein X, Y, and Z are each independently selected from the group consisting of hydrogen, substituted and unsubstituted benzyl, phenyl, and cyclohexyl rings; $-CH_2R$, $-CH_2RSO_3$, $-CH_2ROH$ where R is a substituted or unsubstituted alkyl chain of one or two carbon atoms Z where $n$ is an integer of one to 7, and provided that not more than two members of X, Y, and Z are hydrogen, B. sulfoalkyl sulfide compounds containing the grouping $-S-Alk-SO_3M$ where M is one gram-equivalent of a cation and —Alk— is a divalent aliphatic hydrocarbon group of 1 to 8 carbon atoms.

32 Claims, No Drawings

ELECTRODEPOSITION OF COPPER

This application is a continuation-in-part of U.S. Pat. application Ser. No. 315,112 filed Dec. 14, 1972, now abandoned.

This invention relates to novel compositions and to a process for electrodepositing copper from an aqueous acidic copper plating bath containing at least one member from each of the following two groups:

A. an aryl, aralkyl or cycloaliphatic amine exhibiting the formula:

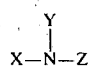

wherein X, Y, and Z are each independently selected from the group consisting of hydrogen, substituted and unsubstituted benzyl, phenyl, and cyclohexyl rings; $—CH_2R$, $—CH_2RSO_3$, $—CH_2ROH$ where R is a substituted or unsubstituted alkyl chain of one or two carbon atoms

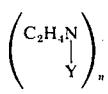

Z where $n$ is an integer of one to 7, and

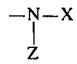

provided that not more than two members of X, Y, and Z are hydrogen,

B. sulfoalkyl sulfide compounds containing the grouping $—S—Alk—SO_3M$ where M is one gram-equivalent of a cation and —Alk— is a divalent aliphatic hydrocarbon group of 1 to 8 carbon atoms.

It is an object of this invention to obtain smooth, high-speed copper electrodeposits for rotogravure applications, especially deposits possessing a relatively high permanent hardness. It is another object to obtain smooth, ductile copper deposits of high throwing power for the plating of printed circuit boards. Another object is to obtain relatively thick, smooth ductile, low-stressed copper deposits. A further object is to obtain strongly leveled, almost bright to bright copper deposits, which require the presence of a leveling agent in addition to the presence of at least one member of each of the two groups (A) and (B).

DETAILED DESCRIPTION

Practice of this invention results in copper deposits which, depending on bath composition and operating conditions, are very suitable for rotogravure applications, or for the plating of printed circuit boards, or for electroforming, or are fully bright and strongly leveling for decorative purposes. These advantages are realized by addition of at least one member of each of the following two groups:

A. an aryl, aralkyl or cycloaliphatic amine exhibiting the formula:

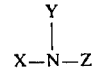

wherein X, Y, and Z are each independently selected from the group consisting of hydrogen, substituted and unsubstituted benzyl, phenyl, and cyclohexyl rings; $—CH_2R$, $—CH_2RSO_3$, $—CH_2ROH$ where R is a substituted or unsubstituted alkyl chain of one or two carbon atoms

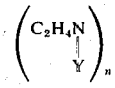

Z where $n$ is an integer of one to 7, and

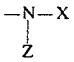

provided that not more than two members of X, Y, and Z are hydrogen,

B. sulfoalkyl sulfide compounds containing the grouping $—S—Alk—SO_3M$ where M is one gram-equivalent of a cation and —Alk— is a divalent aliphatic hydrocarbon group of 1 to 8 carbon atoms which may be saturated or unsaturated, which may or may not carry substituents such as hydroxyl, alkyl, hydroxyalkyl groups, and in which the carbon chain may be interrupted by heteroatoms.

To obtain strongly leveling copper deposits, and often also to obtain fully bright copper deposits over a wide current density range, further addition of at least one member of the group of leveling agents that is diffusion controlled inhibitors, (Group (C)) is required.

Simultaneous presence of at least one member of each group (A) and (B) in the acid copper bath produces superior copper electrodeposits to those obtained when only members of one group are present in respect to one or more of the following properties: greater smoothness, greater brightness, greater hardness, or greater softness and ductility, and/or better response to the addition of a leveling agent.

Thus, this invention consists in the cooperative or synergistic action of at least two groups of addition agents:

A. an aryl, aralkyl or cycloaliphatic amine exhibiting the formula:

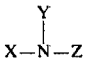

wherein X, Y, and Z are each independently selected from the group consisting of hydrogen, substituted and unsubstituted benzyl, phenyl, and cyclohexyl rings; $—CH_2R$, $—CH_2RSO_3$, $—CH_2ROH$ where R is a substituted or unsubstituted alkyl chain of one or two carbon atoms

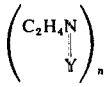

Z where $n$ is an integer of one to 7, and $$-\underset{\underset{Z}{|}}{N}-X$$

provided that not more than two members of X, Y, and Z are hydrogen,

B. sulfoalkyl sulfide compounds containing the grouping —S—Alk—$SO_3M$ where M is one gram-equivalent of a cation and —Alk— is a divalent aliphatic hydrocarbon group of 1 to 8 carbon atoms, and in the case of strongly leveling copper deposits in the cooperative action of at least three groups of addition agents, namely (A), (B) and leveling agents (Group (C)).

Besides members of the two groups (A) and (B) or of the three groups (A), (B) and (C) other addition agents may be present and impart a cooperative (synergistic) effect, especially aldehyde-naphthalene sulfonic acid condensation products and polyethers.

In many cases, especially when strongly leveling fully bright copper deposits are to be obtained, the presence of small amounts of halide ions, especially chloride ions, in the copper bath is necessary.

The amines of this invention may be present in the copper bath of this invention in effective amounts of 0.005 grams per liter to 40 grams per liter of total aqueous bath composition.

Typical amines which may be employed according to this invention include the following compounds which are summarized in Table I.

TABLE I

COOPERATING AMINES

1. $C_6H_5CH_2NHCH_2C_6H_5$

2. $C_6H_5CH_2N(CH_2C_6H_5)(CH_2)_2OH$

3. $C_6H_5CH_2N(CH_2C_6H_5)[(CH_2)_2O]_3H$

4. $C_6H_5CH_2N(CH_2C_6H_5)(CH_2)_3SO_3^-$

5. $C_6H_5CH_2N(CH_2C_6H_5)C_3H_6OH$

6. $C_6H_5CH_2NHC_6H_5$

7. $C_6H_5CH_2N(C_6H_5)(CH_2)_3SO_3^-$

8. $C_6H_5CH_2N(C_6H_5)C_2H_5$

9. $C_6H_5NHCH_2CHOHC_6H_5$

10. $C_6H_5N(CH_2CHOHC_6H_5)(CH_2)_3SO_3^-$

11. 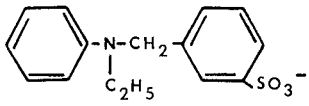

12. 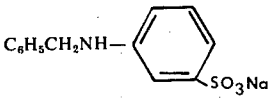

13. 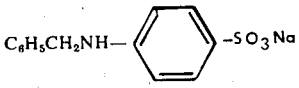

TABLE I-continued

| | | |
|---|---|---|
| 14. | $C_6H_5CH_2NH-C_6H_4-OH$ | |
| 15. | $(C_6H_5CH_2)_3N$ | |
| 16. | 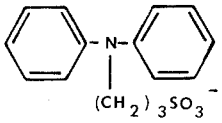 | and products formed by its molecular rearrangement on heating. |
| 17. | 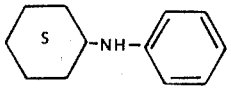 | |
| 18. | 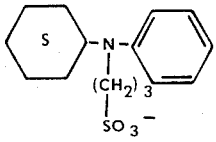 | |
| 19. | $C_6H_5CH_2NH_2$ | |
| 20. | $C_6H_5CH_2N(CH_3)_2$ | |
| 21. | $C_6H_5CH_2N(CH_2CH_2OH)_2$ | |
| 22. | $C_6H_5NH_2$ | |
| 23. | $C_6H_5NHC_2H_5$ | |
| 24. | $C_6H_5N(CH_2CH_2OH)_2$ | |
| 25. | $C_6H_5N(C_3H_7OH)_2$ | |
| 26. | 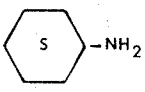 | |
| 27. | 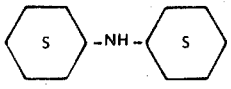 | |
| 28. | 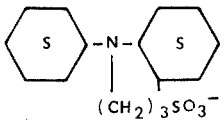 | |
| 29. | $(C_6H_5CH_2)_2N(CH_2)_2NH_2$ | |
| 30. | $(C_6H_5CH_2)_2N(CH_2)_2NH(CH_2)_2OH$ | |
| 31. | $(C_6H_5CH_2)_2N(C_2H_4N)_2$ to $_6H$ | |
| 32. | Reaction product of 1 mole Hydrazo-benzene with 2 moles propane sultone; probably $C_6H_5N(CH_2)_3SO_3^--NC_6H_5(CH_2)_3SO_3^-$ | and products formed by its molecular rearrangement on heating. |
| 33. | $C_6H_5CH_2NHCH_2CH_2NHCH_2C_6H_5$ | |
| 34. | $C_6H_5CH_2N(CH_2)_3SO_3^-CH_2CH_2N(CH_2)_3SO_3^-CH_2C_6H_5$ | |

The cooperating sulfoalkylsulfides exhibit the formula:

$$RS - Alk - SO_3M$$

where M denotes one gram-equivalent of a cation and — Alk — is a divalent aliphatic group of 1–8 carbon atoms; — Alk — may be a saturated or unsatured divalent aliphatic hydrocarbon group, which may or may not carry inert substituents such as hydroxyl, alkyl, hydroxyalkyl, and alkoxy in which the carbon chain may be interrupted by heteroatoms. Typical examples of — Alk — are:

$-(CH_2)_m-$ where $m$ is 1 to 8, $-CH_2CHOHCH_2-$, $-CH_2\underset{\underset{CH_2OH}{|}}{CH}-$, $-CH_2\overset{\overset{CH_3}{|}}{CH}CH_2-$, $-\overset{\overset{CH_3}{|}}{\underset{\underset{CH_3}{|}}{C}}-CH_2-\overset{\overset{CH_3}{|}}{CH}-$, $-CH_2\ CH = CH\ CH_2-$, $-CH_2\ C \equiv C\ CH_2-$, $-CH_2\ CH_2\ O\ CH_2\ CH_2-$.

In the compound $R-S-Alk-SO_3M$, R may be a hydrocarbon radical preferably selected from the group consisting of alkyl, alkenyl, alkynyl, cycloalkyl, aryl, aralkyl, alkaryl, including such radicals when inertly substituted such as preferably sulfoalkyl. R may be a sulfide or polysulfide containing up to four bivalent sulfur atoms of these hydrocarbon radicals, such as Alk $S_n$- and $MO_3S-Alk-S_n$-, where $n = 1$ to 4; or it may be a sulfoalkylthioalkyl group such as $MO_3$-S—Alk—S—Alk—.

R may be hydrogen or a metal cation or their sulfides and polysulfides $MS_n$-. It may be a sulfonic group $MO_3S-$ (e.g. in the reaction product of sodium thiosulfate and 1,3-propanesultone), $MO_3SAlk\ \underset{\underset{S}{\|}}{SC}-$, $(Alkyl)_2N\underset{\underset{S}{\|}}{C}-$, $Alkyl\ O\underset{\underset{S}{\|}}{C}-$, an aminoiminomethyl (formamidine) group

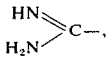

a 1,1-dioxytetrahydrothienyl (sulfolanyl) group

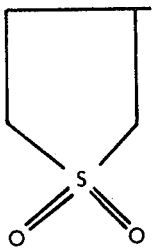

or a heterocyclic ring which may be substituted by other sulfoalkylsulfide groups, etc.

The sulfoalkylsulfides may be employed in effective amounts of 0.01 mg/l to 1000 mg/l of total aqueous bath composition. Typical sulfoalkylsulfides which may be employed according to this invention include the following compounds which are summarized in Table II.

TABLE II

COOPERATING SULFOALKYL SULFIDES (SAS) OF THE FORMULA RS—ALK—$SO_3M$

| SAS No. | R | Alk | M |
|---|---|---|---|
| 1 | $NaO_3S(CH_2)_3S$ | $-(CH_2)_3-$ | Na |
| 2 | $NAO_3S(CH_2)_3SS$ | $-(CH_2)_3-$ | Na |
| 3 | $NaO_3S(CH_2)_4S$ | $-(CH_2)_4-$ | Na |
| 4 | $C_6H_5S$ | $-(CH_2)_3-$ | Na |
| 5 | 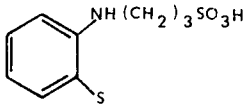 | $-(CH_2)_3$ | Na |
| 6 | H | $-(CH_2)_2-$ | Na |
| 7 | H | $-(CH_2)_3-$ | Na |
| 8 | $NaO_3S$ | $-(CH_2)_3-$ | Na |
| 9 | $NaO_3S(CH_2)_3\underset{\underset{S}{\|}}{SC}$ | $-(CH_2)_3-$ | Na |
| 10 | $(C_2H_5)_2N\underset{\underset{S}{\|}}{C}$ | $-(CH_2)_3-$ | Na |
| 11 | $C_2H_5O\underset{\underset{S}{\|}}{C}$ | $-(CH_2)_3-$ | K |
| 12 | $NaO_3S(CH_2)_3$ | $-(CH_2)_3-$ | Na |
| 13 | $NaO_3S(CH_2)_3S(CH_2)_3$ | $-(CH_2)_3-$ | Na |
| 14 | $NaO_3S(CH_2)_3S(CH_2)_6$ | $-(CH_2)_3-$ | Na |
| 15 | $C_6H_5$ | $-(CH_2)_3-$ | Na |
| 16 | $C_6H_5CH_2$ | $-(CH_2)_3-$ | Na |
| 17 | $HN{=}C(NH_2)$ | $-(CH_2)_3-$ | Na |
| 18 | $NaO_3SCH_2CHOHCH_2S$ | $-CH_2CHOHCH_2-$ | Na |
| 19 | 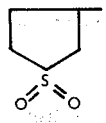 | $-(CH_2)_3-$ | Na |
| 20 | 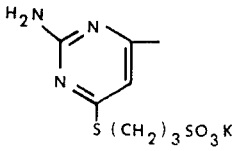 | $-(CH_2)_3$ | K |

TABLE II-continued

| COOPERATING SULFOALKYL SULFIDES (SAS) OF THE FORMULA RS—ALK—$SO_3M$ | | | |
|---|---|---|---|
| SAS No. | R | Alk | M |
| 21 | 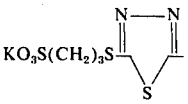 | $-(CH_2)_3-$ | K |

Another aspect of this invention is the one of obtaining strongly leveled copper deposits, that is copper deposits which are substantially smoother than the substrate on which they are deposited. In order to possess leveling properties the acid copper plating bath must contain besides at least one member of each of the groups (A) and (B) also at least one member of group (C) comprising the leveling agents, i.e. diffusion controlled inhibitors.

Besides producing leveling the leveling agent frequently also increases brightness, and widens the bright current density range. It may also prevent roughness formation at high current density and increase hardness.

An acid copper bath containing at least one additive from each of the two groups (A) and (B) responds much better to the addition of a leveling agent than a copper bath containing only members of one of the two groups or no members of these two groups.

Leveling agents which cooperate very well with addition agents of groups (A) and (B) are those containing

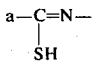

group or its tautomeric form

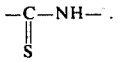

These tautomeric groups may be of a non-cyclic molecule, such as an open thiourea in which they become a part of the wider groups

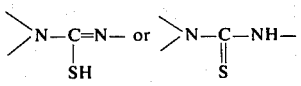

or they may be a part of heterocyclic rings where they may become a part of the wider groups

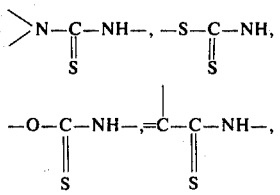

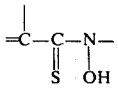

and/or their corresponding tautomeric forms.

Typical leveling agents of the open thiourea type operable in the practice of this invention are set forth in Table III of U.S. Pat. No. 3,682,788 which issued Aug. 8, 1972, upon the application of O. Kardos et al., e.g., thiourea, N-ethylthiourea(1-ethylthiourea), N,N'-diethylthiourea (1,3-diethylthiourea), N-phenylthiourea(1-phenylthiourea), etc.

Typical leveling agents of the heterocyclic type are set forth in Table III of U.S. Pat. No. 3,542,655 which issued Nov. 24, 1970, upon the application of O. Kardos et al., e.g., 2-thiazolidinethione (2-mercaptothiazoline), 2-imidazolidinethione(ethylenethiourea) and its N-hydroxyethyl derivative, 2-pyrimidinethiol(2-mercaptopyrimidine) and in Table III of U.S. Pat. application Ser. No. 264,193 of O. Kardos et al., filed June 19, 1972, now U.S. Pat. No. 3,804,729, e.g. 2-mercaptopyridine, 2-mercaptoquinoline, their N-oxides, and other derivatives in which the —SH group is replaced by

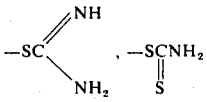

and similar groups. Also levelers which instead of the group

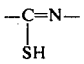

contain the corresponding mercury compound

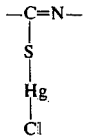

cooperate very well with the Amine plus Sulfoalkylsulfide combination.

A different type of cooperating leveling and brightening agent comprises relatively high-molecular cations such as basic phenazine azo dyestuffs like Janus Green B (diethylphenosafranine azo dimethylaniline, color Index No. 11050) or Janus Black (diethylphenosafranine azo phenol, C. I. Basic Black 2, Color Index No. 11825), and certain cationic polymers such as the polyalkyleneimines and the polymers and copolymers of 2-vinylpyridine and/or 2-methyl-5-vinylpyridine and their quaternization products with alkyl halides, benzyl halides, or 1,3-propanesultone. Simultaneous use of at least one member of each of these two types of leveling agents, together with at least one member of each group (A) and (B), results in beneficial effects as compared with those obtained with levelers of only one type, in respect to the degree and the current density range of brightness and leveling.

Another type of compounds which often exerts beneficial effects on the copper electrodeposit when used in conjunction with at least one compound of each of the two groups (A) and (B), or of each of the three groups (A), (B) and (C) are the condensation products of an aldehyde, especially formaldehyde, with naphthalene sulfonic acids, such as methylene bis-(2-naphthalene sulfonic acid) or higher molecular condensation products of this type in which, for instance, three, or, more generally, *n*, naphthalene sulfonic acid groups are linked by two, or, more generally, *n*-1, methylene groups. Addition of such compounds, e.g. of 0.6 or 2.0 g/l of the sodium salt of methylene bis-(2-naphthalene sulfonic acid) often increases the brightness and high current density smoothness of copper deposits as compared with deposits obtained from copper baths containing only members of groups (A) and (B), or only members of groups (A), (B) and (C), as shown in Examples 5, 6, 7, 8, and 10.

Still another type of compounds which often exerts beneficial effects when used in conjunction with compounds of the two groups (A) and (B), or with compounds of the three groups (A), (B) and (C) are the polyethers, especially those of rather high molecular weight. As dilute concentrations as 0.001 g/l to 0.005 g/l of a polyethyleneglycol of a molecular weight of 1000 or 6000 or 20,000, or of a nonylphenol condensate with 100 moles ethylene oxide, or of a block polymer of 80% ethylene oxide and 20% propylene oxide and approximate molecular weight 9000, considerably increase leveling, especially in the low current density area, and often also increases brightness and bright current density range (See examples 1, 2, 8 and 20).

The polyether additives may be employed in amounts of 0.005 to 1 gram per liter.

The novel compositions of the invention may be employed in combination with aqueous acidic copper plating baths. Typical aqueous acidic copper plating baths which may be employed in combination with the novel additive compositions of this invention include the following:

| | | |
|---|---|---|
| | SULFATE BATH | |
| (1) | $CuSO_4.5H_2O$ | 30–300 g/l |
| | $H_2SO_4$ | 10–250 g/l |
| | $Cl^-$ | 0–150 mg/l |
| | FLUOBORATE BATH | |
| (2) | $Cu(BF_4)_2$ | 50–600 g/l |
| | $HBF_4$ | 1–300 g/l |
| | $H_3BO_3$ | 0–30 g/l |
| | $Cl^-$ | 0–150 mg/l |

For the deposition of bright, leveling copper about 220 g/l of $CuSO_4.5H_2O$ or $Cu(BF_4)_2$, about 60 g/l of $H_2SO_4$ or 3.5 g/l of $HBF_4$, and about 20 to 80 mg/l of chloride ion are preferred. For high-speed plating, e.g., the plating of printing rolls, higher concentrations of the free acids and/or of the copper fluoborate are often preferred. For the plating of printed circuit boards, which requires high throwing power, low metal and high acid concentrations are most suitable.

The plating conditions for electrodeposition from the aforementioned baths may, for example, include temperatures of 10°–60°C. (preferably 20°–40°C.); pH (electrometric) of less than about 2.5; and a cathode current density of 0.1–50.0 amperes per square decimeter (asd).

The substrates which may be electroplated in accordance with the process of this invention may include ferrous metals, such as steel, iron, etc., bearing a surface layer of nickel or cyanide copper; zinc and its alloys including zinc-base die-cast articles bearing a surface layer of cyanide copper or pyrophosphate copper; nickel, nickel alloys with other metals such as cobalt; aluminum, including its alloys, after suitable pretreatment; and non-conducting materials, e.g., plastics, after suitable pretreatment, etc.

The following examples are set forth for the purpose of providing those skilled-in-the-art with a better understanding of this invention, and the invention is not to be construed as limited to such examples.

The plating experiments reported in the following examples were performed — unless otherwise stated — in a Hull Cell containing 250 ml of acid copper sulfate bath. The Hull Cell allows one to observe the appearance of the deposite over a wide current density range. In order to judge the degree of leveling the polished brass panels used for these plating tests were scratched with 4/0 emery polishing paper over a horizontal band of about 10 mm. width. The plating temperature used in these experiments was the ambient room temperature (24°–30°C.) unless otherwise stated. The total current was 2 amperes and the plating time 10 minutes. Air agitation was used in all cases. The amines used are listed in Table I, the sulfoalkylsulfides in Table II.

Two types of acid sulfate copper baths were used in these experiments:

| | | |
|---|---|---|
| Type 1.) | Regular Sulfate Copper containing | |
| | $CuSO_4.5H_2O$ | 220 g/l |
| | $H_2SO_4$ | 60 g/l |
| | Chloride ion | 0.06 g/l |
| and Type 2.) | High-Throw Sulfate Copper containing | |
| | $CuSO_4.5H_2O$ | 100 g/l |
| | $H_2SO_4$ | 200 g/l |
| | Chloride ion | 0.06 g/l |

The chloride concentrations indicated above are those after addition of the various additives as some amines of Table I contain chloride.

The hardness values given in the various examples refer to microhardness obtained with a diamond pyramid indenter under a load of 50 grams ($DPH_{50}$) on copper deposits about 0.025 mm. thick.

EXAMPLE I

From an acid sulfate copper bath of Type 1 and in presence of 1 g/l of Amine No. 1 the copper deposit was matte, striated and brittle over most of the current density range. Further addition of 0.015 g/l Sulfoalkylsulfide No. 1 eliminated striations and brittleness and the deposit was bright, but not leveling to a substantial degree, from about 2.5 amp./sq. dm. upwards. Final addition of 0.002 g/l N-ethylthiourea produced a fully bright deposit over the whole current density range of the Hull Cell (0 to about 12 amp./sq. dm.), which was ductile and strongly leveling from about 0.5 amp./sq. dm. upwards.

In presence of small amounts of polyethers very good bright and strongly leveling copper deposits can be obtained at considerably lower concentrations of amine. For instance a bath of type No. 1 containing only 0.2 to 0.4 g/l of Amine No. 1 plus 0.005 g/l of a polyethylene glycol of molecular weight 1000 gives in presence of 0.015 g/l of Sulfoalkylsulfide No. 1 and of 0.0015 g/l 2-mercaptothiazoline (2-thiazolidinethinone) a bright, leveling copper deposit which is by far superior to the deposits obtained when either Amine No. 1 or Polyethylene glycol 1000 are absent.

EXAMPLE II

In a copper bath of Type 1, addition of 0.2 g/l of Amine No. 2 gave a reddish matte partly striated copper deposit over most of the Hull Cell panel.

Further addition of 0.015 g/l of Sulfoalkylsulfide No. 1 eliminated the striations and produced a hazy bright deposit over part of the Hull Cell panel.

Further addition of 0.0015 g/l of N-ethylthiourea strongly increased brightness and bright current density range, and produced strong leveling from about 2 amp./sq.dm. upwards. Addition of 0.001 to 0.005 g/l of a high-molecular polyether, such as $HO(C_2H_4O)_{450}H$ or $HO(C_3H_6O)_{15}(C_2H_4O)_{165}—(C_3H_6O)_{15}H$ or $C_9H_{19}—C_6H_4—O(C_2H_4O)_{100}H$, together with the N-ethylethiourea, increased leveling especially in the 1 to 2 amp./sq.dm. range as well as brightness.

When, instead of the N-ethylthiourea, 0.004 g/l of 2-mercaptopyridine N-oxide or 0.01 g/l of polyethyleneimine (MW 600) or 0.004 to 0.02 g/l of Janus Green B or Janus Black or 0.005 to 0.015 g/l of a quaternized 2-methyl-5-vinylpyridine polymer of approximate molecular weight 40,000 were added to the copper bath containing o.2 g/l of Amine No. 2 and 0.015 g/l of Sulfoalkylsulfide No. 1, comparable favorable results were obtained. The combination of 0.2 g/l to 0.4 g/l of Amine No. 2, 0.015 g/l of Sulfoalkylsulfide No. 1, 0.011 g/l Janus Green B and 0.0015 g/l of N-ethylthiourea gives in a copper bath of Type 1, a higher degree and a wider current density range of brightening and leveling than can be obtained when either the Janus Green B or the N-ethylthiourea is omitted.

EXAMPLE III

In a copper bath of Type 1 addition of 1 g/l of Amine No. 4 gave a reddish matte partly striated copper electrodeposit. Further addition of 0.015 g/l of Sulfoalkylsulfide No. 1 gave smooth, bright copper deposits from about 1.2 amp./sq. dm. upwards. Final addition of 0.001 g/l of 2-mercaptothiazoline (2-thiazolidinethione) and 0.001 g/l of 2-hydroxyethylethylenethiourea (1-(2-hydroxyethyl)-2-imidazolidinethione) produced a bright copper deposit over the whole Hull Cell current density range with very strong leveling properties.

EXAMPLE IV

In a copper sulfate bath of Type 1 addition of 0.8 g/l of Amine No. 7 gave in the Hull Cell a deposit which varied from almost bright at very low current density to almost matte at the high current density end of the Hull Cell panel. Appearance, hardness, ductility were strongly influenced by the presence or absence of impurities.

Addition of very small amounts of sulfoalkylsulfides makes the copper deposits more uniform and more lustrous and allows to obtain more reproducible microhardness values of $DPH_{50}$ about 155 to 160. On increase of the sulfoalkylsulfide concentration the copper deposit becomes softer, more ductile and frequently brighter, at least in the medium to high current density range. At about 0.015 g/l of sulfoalkylsulfide, besides 0.8 g/l of Amine No. 7, the plating solution often responds very favorable to the addition of leveling agents.

For instance, relatively hard ($DPH_{50}$ = 155 to 165) not especially ductile, uniformly semibright copper deposits were obtained with 0.0005 g/l (=0.5 mg/l) Sulfoalkylsulfide No. 4 or 0.0001 g/l of Sulfoalkylsulfide No. 9 or 0.0001 to 0.0005 g/l of Sulfoalkylsulfide No. 10, together with 0.8 g/l of Amine No. 7.

Much brighter, considerably softer ($DPH_{50}$ = 80 to 85) and very ductile copper deposits were obtained in presence of 0.8 g/l of Amine No. 7 at higher concentrations of sulfoalkylsulfides e.g., at 0.002 g/l of Sulfoalkylsulfide No. 4 or No. 5, at 0.015 g/l (= 15 mg/l) of Sulfoalkylsulfide No. 8 or No. 19, at and above 0.0005 g/l of Sulfoalkylsulfide No. 9, and at 0.002 g/l of Sulfoalkylsulfide No. 10.

The hard copper deposits should be especially suitable for rotogravure purposes, particularly when the Helioklischograph engraver is used, while the soft, ductile deposits should be particularly useful for electroforming and — especially in the High-Throw copper bath of Type 2 — for the plating of printed circuit boards.

On increase of the sulfoalkylsulfide concentration to about 0.015 g/l, the brightness of the copper deposit in the medium and low current density range may decrease but the plating solution may respond very favorably to the addition of leveling agents such as N-ethylthiourea (0.002 g/l), N,N'-diethylthiourea (0.002 g/l), 2-mercaptothiazoline (0.0015 g/l), 2-mercaptopyridine-N-oxide (0.004 g/l) etc. With Amine No. 7 and in presence of these levelers, Sulfoalkylsulfides Nos. 1, 4, 5 and 9 gave especially good bright leveling copper deposits.

When used as the only additives (in absence of amines) the sulfoalkylsulfides scarcely showed any benefits. For instance Sulfoalkylsulfides Nos. 1, 8 or 9 showed at 0.001 and/or 0.015 g/l brightening only of a very narrow current density range near the high current density edge of the Hull Cell panel (around 12 amp./dm.$^2$). At 0.06 or 0.12 g/l even this narrow bright range disappeared; the copper deposit was dark reddish matte and showed bad low current density coverage.

Sulfoalkylsulfide No. 10 showed at 0.06, 0.12 and 0.5 g/l a slight brightening of the Hull Cell panel below the about 1.2 amp./sq.dm. but there was no favorable response to the addition of levelers such as N-ethylthiourea or 2-mercaptothaizoline.

These facts prove that there exists a clear case of twofold synergism (or cooperation) between the amines of our invention and the sulfoalkylsulfides, and often also a threefold synergism between amines, sulfoalkylsulfides and leveling agents.

EXAMPLE V

From a High-Throw copper bath of Type 2 containing 0.4 g/l of Amine No. 16 (prepared by heating of 1 mole diphenylamine with 1 mole 1,3-propanesultone to about 200°C.) a very uniform satin ductile copper deposit with very good back coverage of the Hull Cell panel was obtained. Addition of 0.0015 g/l (1.5 mg/l) of Sulfoalkylsulfide No. 1 brightened the deposit considerably and maintained very good back coverage and ductility. Final addition of 0.6 g/l of the sodium salt of methylene bis-(2-naphthalene sulfonic acid) further increased brightness and uniformity of the copper deposit.

EXAMPLE VI

In a copper bath of Type 1, 1 g/l of Amine No. 11 produced a matte copper deposit in the Hull Cell. Further addition of 0.015 g/l (15 mg/l) of Sulfoalkylsulfide No. 1 brightened the deposit from about 3 amp./dm.$^2$ upwards and this electrolyte responded well to the addition of 0.0015 g/l of the leveling agent 2-mercaptothiazoline, giving a bright leveling copper deposit over a wide current density range.

In the High-Throw copper bath (Type 2) simultaneous use of only 0.2 g/l of Amine No. 11, 0.6 g/l of methylene-bis-(2-naphthalene sulfonic acid) sodium salt and 0.0015 g/l (=1.5 mg/l) of Sulfoakylsulfide No. 1 gave an almost bright copper deposit up to about 10 amp./sq.dm. with good back coverage, which should be very suitable for the plating of printed circuit boards.

EXAMPLE VII

In a copper bath of Type 1, 8 g/l of Amine No. 20 gave a matte copper deposit above about 0.4 amp./sq.dm. Addition of 0.015 g/l Sulfoalkylsulfide No. 1 brightened the copper deposit from about 2.5 amp./sq.dm. upwards. On final addition of 0.0017 g/l of 2-mercaptothiazoline a fully bright copper deposit was obtained from about 0.2 amp./sq.dm. upwards with strong leveling properties in the high and medium current density range. EXAMPLE VIII When Amine No. 20 in Example VII is replaced by 20 g/l of Amine No. 23 a similar cooperation with Sulfoalkylsulfide No. 1 and 2-mercaptothiazoline is observed.

EXAMPLE IX

Addition of 0.1 g/l of Amine No. 34 to a copper bath of Type 1 gave a copper deposit which was strongly striated above about 1 amp./sq.dm. and almost bright below this current density. Further addition of 0.015 g/l of Sulfoalkylsulfide No. 1 produced a bright, ductile copper deposit from about 1.2 amp./sq.dm. to the end of the Hull Cell panel (more than 12 amp./sq.dm.). Final addition of 0.002 g/l N-ethylthiourea produced a strongly leveling copper deposit which was bright over most of the Hull Cell panel.

The unreacted Amine No. 33 gave less favorable results than its propanesultone reaction product, Amine No. 34. Amine No. 33 showed less cooperation with Sulfoalkylsulfide No. 1 and almost none with N-ethylthiourea as the third additive.

In contrast to the very effective Amine No. 34 the corresponding amine containing no benzyl groups, that is a reaction product of 1 mole ethylenediamine with 2 moles propanesultone, showed at 0.1 g/l, 0.5 g/l or 2.0 g/l no cooperation with 0.015 g/l of Sulfoalkylsulfide No. 1 or with 0.01 to 0.5 g/l of Sulfoalkylsulfide No. 10, either in absence or in presence of 0.002 g/l of N-ethylthiourea.

While the invention has been described and illustrated in detail, it is clearly to be understood that this is intended to be of example only and is not to be taken to be of limitation, the spirit and scope of the invention being limited only by the terms of the following claims.

We claim:

1. A process for electrodepositing copper from an aqueous acidic copper plating bath containing at least one member independently selected from each of the following two groups:

A. 0.005 gram per liter to 40 grame per liter of an aryl, aralkyl or cycloaliphatic amine exhibiting the formula:

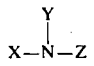

wherein X, Y, and Z are each independently selected from the group consisting of hydrogen, substituted and unsubstituted benzyl, phenyl, and cyclohexyl rings; $—CH_2R$, $—CH_2RSO_3$, $—CH_2ROH$ where R is a substituted or unsubstituted alkyl chain of one or two carbon atoms provided that at least one member of X, Y, and Z is benzyl, phenyl, or cyclohexyl; and B. sulfoalkyl sulfide compounds containing the grouping —Alk—$SO_3M$ where M is one gramequivalent of a cation and —Alk— is a divalent aliphatic hydrocarbon group of 1 to 8 carbon atoms in an amount of 0.01 milligrams per liter to 1000 milligrams per liter.

2. The process as claimed in claim 1 where the cooperating amine is of the formula:

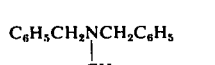

3. The process as claimed in claim 1 where the cooperating amine is of the formula:

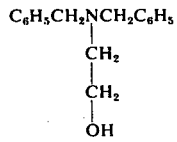

4. The process as claimed in claim 1 where the cooperating amine is of the formula:

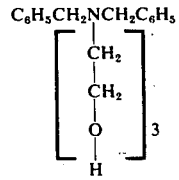

5. The process as claimed in claim 1 where the cooperating amine is of the formula:

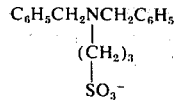

6. The process as claimed in claim 1 where the cooperating amine is of the formula:

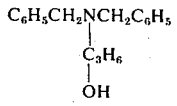

7. The process as claimed in claim 1 wherein the cooperating amine is of the formula:

8. The process as claimed in claim 1 where the cooperating amine is of the formula:

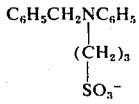

9. The process as claimed in claim 1 where the cooperating amine is of the formula:

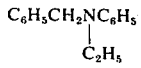

10. The process as claimed in claim 1 where the cooperating amine is of the formula:

11. The process as claimed in claim 1 where the cooperating amine is of the formula:

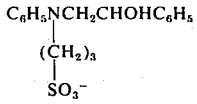

12. The process as claimed in claim 1 where the cooperating amine is of the formula:

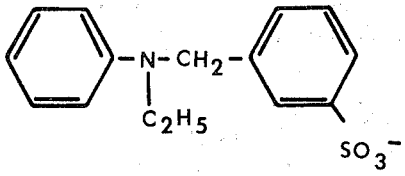

13. The process as claimed in claim 1 where the cooperating amine is of the formula:

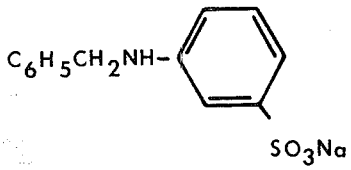

14. A process for electrodepositing copper from an aqueous acidic copper plating bath containing at least one member independently selected from each of the following three groups:

A. 0.005 gram per liter to 40 grams per liter of an aryl, aralkyl or cycloaliphatic amine exhibiting the formula:

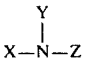

wherein X, Y, and Z are each independently selected from the group consisting of hydrogen, substituted and unsubstituted benzyl, phenyl, and cyclohexyl rings; $—CH_2R$, $—CH_2RSO_3$, $—CH_2ROH$ where R is a substituted or unsubstituted alkyl chain of one or two carbon atoms provided that at least one member of X, Y, and Z is benzyl, phenyl or cyclohexyl;

B. sulfoalkyl sulfide compounds containing the grouping $—Alk—SO_3M$ where M is one gram-equivalent of a cation and —Alk— is a divalent aliphatic hydrocarbon group of 1 to 8 carbon atoms in an amount of 0.01 milligrams per liter to 1000 milligrams per liter; and C. diffusion controlled inhibitors which act as leveling agents which contain at least one group

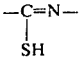

or its tautomer

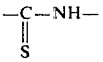

or a cationic organic compound of a molecular weight greater than about 500 selected from the group consisting of phenazine azo dyes, polyethyleneimines, alkylated polyethyeleneimines, polyvinylpyridine, polyvinylalkylpyridines, and their quaternization products in an amount of at least 0.1 milligram per liter and not more than 1 gram per liter.

15. A process for electrodepositing copper from an aqueous acidic copper plating bath containing at least one member independently selected from each of the following three groups:

A. 0.005 gram per liter to 40 grams per liter of an aryl, aralkyl or cycloaliphatic amine exhibiting the formula:

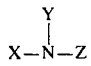

wherein X, Y, and Z are each independently selected from the group consisting of hydrogen, substituted and unsubstituted benzyl, phenyl, and cyclohexyl rings; $—CH_2R$, $—CH_2RSO_3$, $—CH_2ROH$ where R is a substituted or unsubstituted alkyl chain of one or two carbon atoms provided that at least one member of X, Y, and Z is benzyl, phenyl or cyclohexyl;

B. sulfoalkyl sulfide compounds containing the grouping $—Alk—SO_3M$ where M is one gram-equivalent of a cation and —Alk— is a divalent aliphatic hydrocarbon group of 1 to 8 carbon atoms in an amount of 0.01 milligrams per liter to 1000 milligrams per liter; and C. 0.01 gram per liter to 5.0 grams per liter of condensation products of formaldehyde and naphthalene sulfonic acids.

16. An aqueous acidic copper electroplating bath containing at least one member independently selected from each of the following two groups:

A. 0.005 gram per liter to 40 grams per liter of an aryl, aralkyl or cycloaliphatic amine exhibiting the formula:

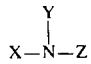

wherein X, Y, and Z are each independently selected from the group consisting of hydrogen, substituted and unsubstituted benzyl, phenyl, and cyclohexyl rings; $—CH_2R$, $—CH_2RSO_3$, $—CH_2ROH$ where R is a substituted or unsubstituted alkyl chain of one or two carbon atoms provided that at least one member of X, Y, and Z is benzyl, phenyl or cyclohexyl; and B. sulfoalkyl sulfide compounds containing the grouping $—Alk—SO_3M$ where M is one gram-equivalent of a cation and —Alk— is a divalent aliphatic hydrocarbon group of 1 to 8 carbon atoms in an amount of 0.01 milligrams per liter to 1000 milligrams per liter.

17. An aqueous acidic copper electroplating bath as claimed in claim 16 wherein the cooperating amine exhibits the formula:

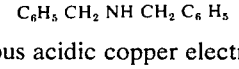

18. An aqueous acidic copper electroplating bath as claimed in claim 16 wherein the cooperating amine exhibits the formula:

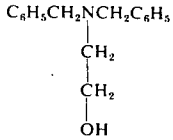

19. An aqueous acidic copper electroplating bath as claimed in claim 16 wherein the cooperating amine exhibits the formula:

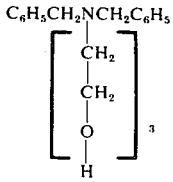

20. An aqueous acidic copper electroplating bath as claimed in claim 16 wherein the cooperating amine exhibits the formula:

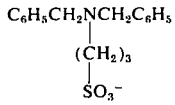

21. An aqueous acidic copper electroplating bath as claimed in claim 16 wherein the cooperating amine exhibits the formula:

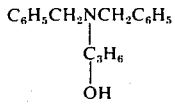

22. An aqueous acidic copper electroplating bath as claimed in claim 16 wherein the cooperating amine exhibits the formula:

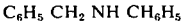

23. An aqueous acidic copper electroplating bath as claimed in claim 16 wherein the cooperating amine exhibits the formula:

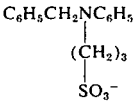

24. An aqueous acidic copper electroplating bath as claimed in claim 16 wherein the cooperating amine exhibits the formula:

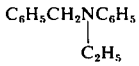

25. An aqueous acidic copper electroplating bath as claimed in claim 16 wherein the cooperating amine exhibits the formula:

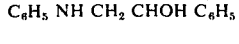

26. An aqueous acidic copper electroplating bath as claimed in claim 16 wherein the cooperating amine exhibits the formula:

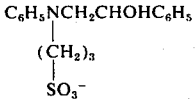

27. An aqueous acidic copper electroplating bath as claimed in claim 16 wherein the cooperating amine exhibits the formula:

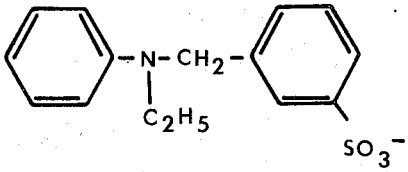

28. An aqueous acidic copper electroplating bath as claimed in claim 16 wherein the cooperating amine exhibits the formula:

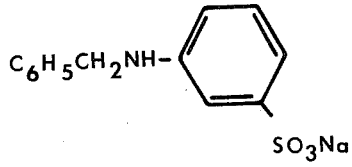

29. An aqueous acidic copper electroplating bath as claimed in claim 16 wherein the cooperating amine exhibits the formula:

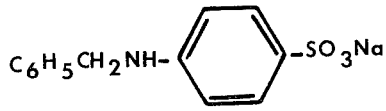

30. An aqueous acidic copper electroplating bath containing at least one member independently selected from each of the following three groups:

A. 0.005 gram per liter to 40 grams per liter of an aryl, aralkyl or cycloaliphatic amine exhibiting the formula:

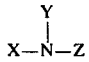

wherein X, Y, and Z are each independently selected from the group consisting of hydrogen, substituted and unsubstituted benzyl, phenyl, and cyclohexyl rings; $—CH_2R$, $—CH_2RSO_3$, $—CH_2ROH$ where R is a substituted or unsubstituted alkyl chain of one or two carbon atoms provided that at least one member of X, Y, and Z is benzyl, phenyl or cyclohexyl;

B. sulfoalkyl sulfide compounds containing the grouping $—Alk—SO_3M$ where M is one gram-equivalent of a cation and —Alk— is a divalent aliphatic hydrocarbon group of 1 to 8 carbon atoms in an amount of 0.01 milligrams per liter to 1000 milligrams per liter; and C. diffusion controlled inhibitors which act as leveling agents which contain at least one group

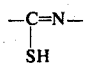

or its tautomer

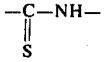

or a cationic organic compound of a molecular weight greater than about 500 selected from the group consisting of phenazine azo dyes, polyethyleneimines, alkylated polyethyleneimines, polyvinylpyridine, polyvinylalkylpyridines, and their quaternization products in an amount of at least 0.1 milligram per liter but not more than 1 gram per liter.

31. A composition for electrodepositing copper from an aqueous acidic copper electroplating bath containing at least one member independently selected from each of the following three groups:

A. 0.005 gram per liter to 40 grams per liter of an aryl, aralkyl or cycloaliphatic amine exhibiting the formula:

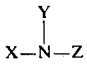

wherein X, Y, and Z are each independently selected from the group consisting of hydrogen, substituted and unsubstituted benzyl, phenyl, and cyclohexyl rings; $—CH_2R$, $—CH_2RSO_3$, $—CH_2ROH$ where R is a substituted or unsubstituted alkyl chain of one or two carbon atoms provided that at least one member of X, Y, and Z is benzyl, phenyl or cyclohexyl;

B. sulfoalkyl sulfide compounds containing the grouping $—Alk—SO_3M$ where M is one gram-equivalent of a cation and —Alk— is a divalent aliphatic hydrocarbon group of 1 to 8 carbon atoms in an amount of 0.01 milligrams per liter to 1000 milligrams per liter; and C. condensation products of formaldehyde and naphthalene sulfonic acids in an amount of 0.01 gram per liter to 5.0 grams per liter.

32. A composition for electrodepositing copper from an aqueous acidic copper plating bath containing at least one member independently selected from each of the following four groups:

A. 0.005 gram per liter to 40 grams per liter of an aryl, aralkyl or cycloaliphatic amine exhibiting the formula:

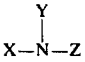

wherein X, Y, and Z are each independently selected from the group consisting of hydrogen, substituted and unsubstituted benzyl, phenyl, and cyclohexyl rings; $—CH_2R$, $—CH_2RSO_3$, $—CH_2ROH$ where R is a substituted or unsubstituted alkyl chain of one or two carbon atoms provided that at least one member of X, Y, and Z is benzyl, phenyl or cyclohexyl;

B. sulfoalkyl sulfide compounds containing the grouping $—Alk—SO_3M$ where M is one gram-equivalent of a cation and —Alk— is a divalent aliphatic hydrocarbon group of 1 to 8 carbon atoms in an amount of 0.01 milligrams per liter to 1000 milligrams per liter;

C. diffusion controlled inhibitors which act as leveling agents which contain at least one group

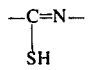
or its tautomer
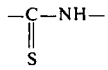
in an amount of at least 0.1 milligram per liter and not more than 1 gram per liter; and
D. 0.005 gram per liter to 1 gram per liter of a polyether containing at least five ether atoms per molecule exhibiting molecular weights between 300 and 5,000,000.
* * * * *